United States Patent [19]

Mochizuki et al.

[11] 4,119,060

[45] Oct. 10, 1978

[54] TONER CHARGING APPARATUS

[75] Inventors: Nobuo Mochizuki, Matsudo; Hiromi Demizu, Yokohama; Hajime Oyama, Tokyo; Teruyuki Ohnuma, Yokohama, all of Japan

[73] Assignee: Ricoh Co., Ltd., Tokyo, Japan

[21] Appl. No.: 815,110

[22] Filed: Jul. 13, 1977

[30] Foreign Application Priority Data

Jul. 16, 1976 [JP] Japan ..... 51/84712
Mar. 18, 1977 [JP] Japan ..... 52/29896

[51] Int. Cl.[2] ..... G03G 15/09

[52] U.S. Cl. ..... 118/653; 118/651; 118/655

[58] Field of Search ..... 118/651, 653, 655, 656, 118/657, 658, 661

[56] References Cited

U.S. PATENT DOCUMENTS

| | | | |
|---|---|---|---|
| 3,566,786 | 3/1971 | Kaufer | 118/657 X |
| 3,572,922 | 3/1971 | Olden | 118/657 X |
| 3,754,526 | 8/1973 | Caudill | 118/658 |
| 3,754,963 | 8/1973 | Chang | 118/655 X |
| 3,863,602 | 2/1975 | Mueller | 118/655 |
| 3,916,830 | 11/1975 | Kojima et al. | 118/658 X |
| 3,918,808 | 11/1975 | Narita | 118/657 X |
| 3,941,469 | 3/1976 | Okamoto | 118/653 X |
| 3,948,218 | 4/1976 | Pfeifer et al. | 118/655 |
| 3,952,701 | 4/1976 | Yamashita et al. | 118/658 |
| 3,990,394 | 11/1976 | Katakura | 118/658 |
| 4,014,291 | 3/1977 | Davis | 118/658 |

*Primary Examiner*—Werner H. Schroeder
*Assistant Examiner*—Andrew M. Falik
*Attorney, Agent, or Firm*—Copper, Dunham, Clark, Griffin & Moran

[57] ABSTRACT

A development apparatus for use with dry type copying apparatus having: a development roller, which is rotated in close proximity to a latent electrostatic image bearing recording material; a hopper for supplying an insulating toner onto the development roller; and a single developer regulating member in the form of a blade having an acute angle tip disposed at the edge of or right behind the outlet of the hopper in such manner that the top surface of the member forms an acute angle with the downstream side in the direction of development roller rotation of a tangent to the development roller at a point right under the tip of the development regulating member. Alternatively a single or a plurality of triboelectric charging members may be disposed at the edge of or right behind the outlet of the hopper of the respective angles with the top surfaces of the blades with respect to the respective tangents to the points on the surface of the development roller right under the respective tips varying from an acute angle to an obtuse angle in the direction of development roller rotation.

8 Claims, 13 Drawing Figures

TONER CHARGING APPARATUS

BACKGROUND OF THE INVENTION

This invention relates to development apparatus for use with electrophotographic copying apparatus, or with electrostatic recording apparatus or the like, and more particularly to a dry type development apparatus for use with electrophotographic copying apparatus employing one-component developer.

In general, in electrophotographic copying apparatus, a photoconductor is electrically charged and is then exposed to the subject matter being imaged to form a latent electrostatic image thereof and in accordance with the electric potential of the latent electrostatic image, electrically charged toner is caused to adhere to the latent electrostatic image by a development apparatus. The developed toner image is then transferred to a paper and fixed thereon. Thus, copies are obtained by a typical electrophotographic copying apparatus.

As to the development apparatus in such electrophotographic copying apparatus, there are two types. One is for use with a so-called two-component developer comprising a toner and a carrier, and the other is for use with a so-called one-component developer comprising only a toner, that is, a developer without a carrier.

In the former development apparatus, it is necessary to incorporate a toner concentration controlling device for keeping the mix ratio of the toner and the carrier constant. Thus, it has some shortcomings, such as being complicated in mechanism, oversized or expensive.

The present invention relates in particular to the latter development apparatus for copying apparatus employing one-component developers.

As one-component developers, there are toner powders comprising resins and pigments, and magnetic toners comprising a mixture of resins and magnetic iron powders or comprising resins containing magnetic powders as the cores of the toners.

As a development apparatus for use with one-component developers, an apparatus having a movable rubber roller and a triboelectric charger positioned in pressure contact with the movable rubber roller has been devised. In this apparatus, insulating toner particles are accommodated in a vacant portion, or a hopper, formed by the rubber roller and the triboelectric charger.

With the rotation of the rubber roller, the toner particles are carried out of the hopper. At this time, a predetermined thickness toner layer is formed on the rubber roller and at the same time, the toner layer is charged triboelectrically with a predetermined polarity. The rubber roller is disposed in close proximity to a latent image bearing photoconductor or recording material and the triboelectrically charged toner particles are selectively supplied to the latent electrostatic image areas and thus the latent images are visualized.

However, this apparatus has the shortcoming that toner particles are dropped or scattered from the gap between the rubber roller and the triboelectric charger and thus many stray toner particles adhere to the latent electrostatic image bearing photoconductor or recording material. This is due to the manner in which the triboelectric charger is brought into contact with the rubber roller for sufficient triboelectric charging of the toner, with the triboelectric charger extending beyond the contact point with the rubber roller. In order to overcome the above shortcoming, the contact pressure of the triboelectric charger against the rubber roller may be increased, until the dropping or scattering of the toner particles is prevented.

However, the toner particles are coagulated or adhere to the surface of the rubber roller due to the increased contact pressure of the triboelectric charger. In this condition, it is impossible to separate the toner particles selectively from the surface of the rubber roller by the electric attraction of the latent electrostatic images formed on the photoconductor. Accordingly, as another shortcoming, good images cannot be obtained by this apparatus.

As in the above-mentioned development apparatus, with development apparatus in general use in electrophotographic copying apparatus, toner is electrically charged by a triboelectric charger at the time or immediately after the toner is deposited on the surface of a development roller, and is then brought into near or actual contact with a photoconductor. However, the condition of the toner layer formed on the peripheral surface of the development roller is changed delicately depending upon the shape of the triboelectric charger. More specifically, the shape of a triboelectric charger has a great effect not only on the formation of the uniform toner layer on the development roller but also on the replenishment of toner and accordingly, it affects various qualities of developed image. Further, depending upon the number of triboelectric chargers, the saturation time of the potential of charged toner is greatly effected.

SUMMARY OF THE INVENTION

It is therefore an object of this invention to provide an improved dry type development apparatus for use with electrophotographic copying apparatus which obviates the shortcoming of developer being dropped or scattered from a hopper of developer.

Another object of this invention is to obviate coagulation or adhesion of developer to a development roller in the dry type development apparatus.

A further object of this invention is to form a uniform and thin layer developer on the development roller so that uniform development can be accomplished.

Still another object of this invention is to accomplish smooth replenishment of developer to the development roller.

Yet another object of this invention is to shorten the saturation time of the potential of charged developer.

In accordance with the above objects, the improved dry type development apparatus is provided with a developer regulating member or a triboelectric charging blade which has a bevelled end disposed in close proximity to the periphery of the development roller with the bevelled surface forming an angle $\theta_1$ in the range of $0° < \theta_1 \leqq 90°$ with the top surface thereof and the top surface also forming an angle $\theta_2$ in the range of $0° \leqq \theta_2 < 90°$ with the plane including both the top edge of the blade bevelled end and the axis of the development roller in the direction downstream of development roller rotation, with the limit that $0 < \theta_1 + \theta_2 \leqq 90°$.

In order to obtain the above objects more efficiently, the improved dry type development apparatus can be provided with a plurality of triboelectric charging blades, with the respective angles of the top surfaces of the blades with respect to the respective tangents to the points of the surface of the development roller right under the respective top surfaces varying from an acute angle to an obtuse angle in the direction of rotation of the development roller.

BRIEF DESCRIPTION OF THE DRAWINGS

FIG. 2 illustrates the arrangement of a developer regulating member with respect to a development roller in a preferred embodiment of development apparatus according to the present invention;

FIGS. 3 and 4 illustrate other arrangements of a developer regulating member to a development roller;

FIG. 5 is a schematic illustration of an electrophotographic copying apparatus employing a development apparatus according to the present invention;

FIG. 6 shows a relationship between the replenishment time of developer and the replenished quantity of developer;

DETAILED DESCRIPTION OF PREFERRED EMBODIMENTS

Figure 1:
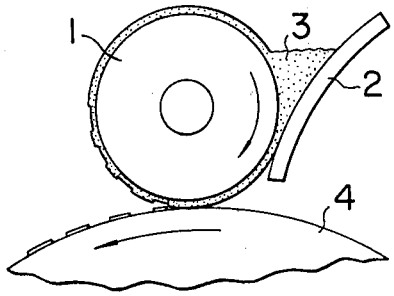
FIG. 1 PRIOR ART
FIG. 1 is a schematic illustration of a conventional development apparatus.

FIG. 1 illustrates a conventional development apparatus for use with one-component developers. This apparatus has movable rubber roller 1 which rotates in the direction of the arrow in FIG. 1 and triboelectric charger 2 positioned in pressure contact with the movable rubber roller 1. Insulating toner particles 3 are accommodated in a vacant portion or a hopper formed by the rubber roller 1 and the triboelectric charger 2. With the rotation of the rubber roller, the toner particles are carried out of the hopper. At this time, a predetermined thickness of toner layer is formed on the rubber roller 1 and at the same time, the toner layer is charged triboelectrically. The triboelectrically charged toner particles are selectively supplied to the latent electrostatic image areas on photoconductor or recording material 4 and thus the latent images are visualized.

As mentioned previously, this apparatus has several shortcomings, such as the dropping or scattering of the toner particles from the hopper, and the coagulation or adhesion of the toner particles to the surface of the rubber roller 1. Thus, satisfactory development cannot be always accomplished by this development apparatus.

FIGS. 2 to 6 relate to one preferred embodiment of development apparatus employing a single developer regulating member or a single triboelectric charging blade according to the present invention.

Figure 2:
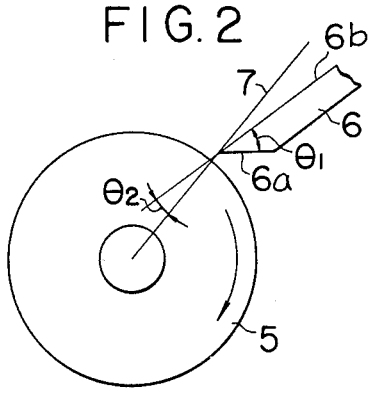
FIGS. 2 to 6 illustrate one preferred embodiment of development apparatus employing a single developer regulating member or a single triboelectric charging blade according to the present invention and the related apparatus thereof.

FIG. 2 illustrates in particular a preferred embodiment of development apparatus according to the present invention. As shown in FIG. 2, development roller 5 is rotated in the direction of the arrow. The development roller 5 is provided with developer regulating member 6 with a predetermined small gap between the roller and the developer regulating member. The developer regulating member 6 has an edge formed by a bevel with an acute angle. In other words, the bevelled surface 6*a* of the developer regulating member 6 forms an angle of $\theta_1$ in the range of $0° < \theta_1 \leqq 90°$ with the top surface 6*b* of the developer regulating member. The developer regulating member 6 having the acute tip is positioned with the bevelled surface 6*a* slanted away from the surface of roller 5 in the rotating direction of the development roller 5, and with the plane 7, including both the axis of the development roller and the edge of the developer regulating member 6, disposed at an angle within the range of $0° \leqq \theta_2 < 90°$ with respect to the upper surface 6*b* of the member 6 in the direction of development roller rotation. When the angle $\theta_1$ formed by the bevelled surface 6*a* with the top surface 6*b* is in the above mentioned range and orientation, the developer regulating member 6 may be almost brought into line contact with the development roller 5, an excessive force is not applied to the toner particles which pass through the gap. Therefore, coagulation of toner particles rarely occurs.

Figure 3:
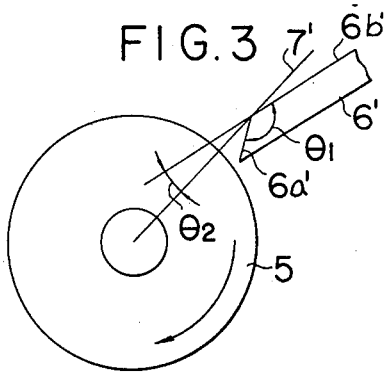

On the other hand, as shown in FIG. 3, when the angle $\theta_1$ formed by the bevelled surface 6*a'* of the developer regulating member 6' and the top surface 6*b'* is in the range of $90° < \theta_1 < 180°$ and the blade is in the same orientation, the space formed by the development roller 5 and the top surface 6*b'* becomes narrower in the direction of the rotating direction of the development roller 5. Thus, the toner particles existing in the space are pressed hard against the development roller 5 by the reaction from the developer regulating member 6'. Due to this reaction, coagulation or adhesion of the toner particles is apt to be caused and accordingly developed image quality becomes poor.

Figure 4:
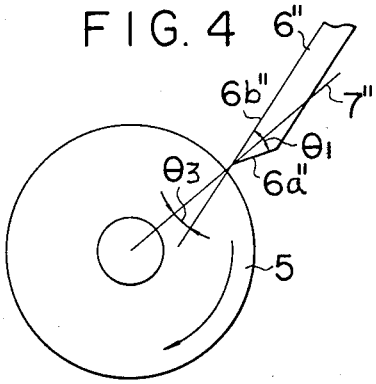

Further, as shown in FIG. 4, even if the angle $\theta_1$ formed by the bevelled surface 6*a''* and the top surface 6*b''* is in the range of $0° < \theta_1 < 90°$, and the bevelled surface 6*a''* is positioned at the side opposite the rotating direction of the development roller 5, if the blade is reoriented so that the plane 7'', including the axis of the development roller 5 and the top edge of the developer regulating member 6'', passes beneath the top surface 6*b''*, forming angle $\theta_3$, the space formed by the development roller 5 and the top surface 6*b''* of the development roller 6'' becomes narrower in the direction of the rotation of the development roller as in the case of FIG. 3 and accordingly the same problem as in the case of FIG. 3 occurs. Therefore, with respect to the angles $\theta_1$, $\theta_2$ and $\theta_3$, it will be noted that they have to satisfy the above mentioned conditions together with the conditions of $0 < \theta_1 + \theta_2 \leqq 90°$ and $\theta_3 = 0$.

Beyond these ranges, the space formed by the development roller 5 and the top surface 6*b* becomes gradually narrower in the rotating direction of the development roller 5 and accordingly the problems as indicated above will occur.

Thus, it is required that the bevelled surface 6a of the developer regulating member 6 form an angle $\theta_1$ with a tangent to the development roller at the cross point of the peripheral surface and the line passing through both the center of the roller and the tip of the developer regulating member 6 and that the above mentioned tangent form an acute angle $\theta_2$ with the top surface 6b of the regulating member 6; both angles being measured from the side of the tangent downstream of the cross point in the direction of rotation of the roller.

Figure 5:
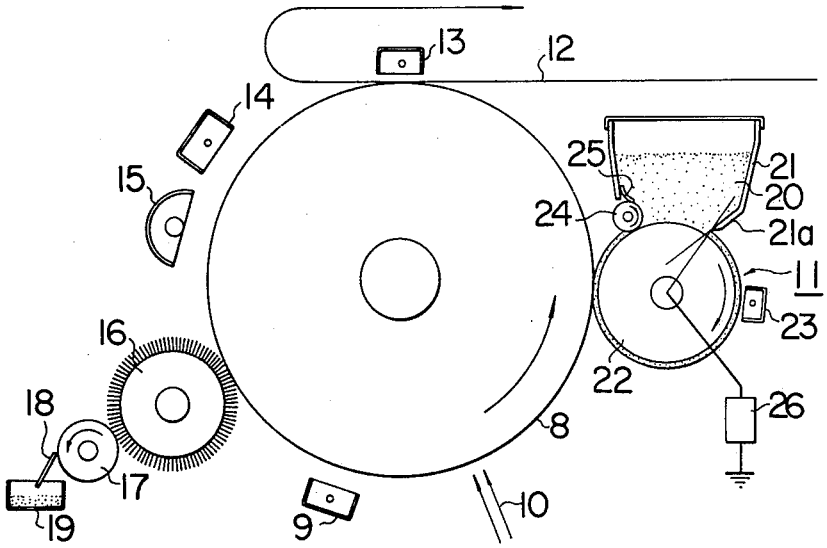

FIG. 5 shows a schematic illustration of an electrophotographic copying apparatus employing the above mentioned apparatus according to the invention. In the figure, the numeral 8 is a photoconductive drum; 9 is a corona discharger; 10 is a light projected in accordance with the subject image of an original against the surface of the photoconductive drum; 11 is a development apparatus; 12 is a path for carrying a transfer paper; 13 is a corona charger for image transfer; 14 is a corona discharger with the polarity opposite to the discharging polarity of the first corona discharger 9 or an alternating current corona discharger; 15 is a lamp illuminating the surface of the photoconductive drum after image transfer; 16 is a brush cleaning roller which removes the toner remaining on the photoconductive drum 8; 17 is a roller for recovering the toner particles adhering to the brush cleaning roller by electrostatic or magnetic attraction; 18 is a cleaning blade for removing the toner particles from the roller 17 by pressure contact with the roller 17; and the toner particles, scraped off the cleaning blade 18, are recovered by container 19.

The development apparatus 11 comprises hopper 21 holding developer 20 and development roller 22 which is rotated so as to carry the developer from the hopper 21 and into contact with the electrostatic latent images formed on the photoconductive drum 8. Developer regulating member 21a, mounted at the outlet of the hopper 21, forms a developer layer with a predetermined thickness on the surface of development roller 22, which developer layer is electrically charged to a polarity opposite to that of the electrostatic images by corona discharger 23. The developer not used in the development of the image on drum 8 is returned on the roller surface to the hopper 21. In this case, when the gap formed by the inlet portion of the hopper 21 and the development roller 22 is too small, the toner particles are scattered at the inlet. In order to prevent the scattering of the toner particles, roller 24 is mounted at the inlet so as to be brought into light contact with the development roller 22. In this manner any overflow of the developer 20 from the hopper 21 or the scattering of the developer on the development roller 22 is prevented when developer is returned to the hopper 21.

The materials of this roller 24, may be metal or rubber can be used as well. It is preferable for the roller 24 to be rotated in the same direction as the development roller 22 at their contact portion and at an identical speed or at a greater speed than that of the development roller 22.

Further, elastic blade 25 may be mounted with one end brought into contact with the roller 24 and thus the developer adhering to the roller 24 is scraped off and scattering of the developer outside of the hopper 21 is prevented.

As the development roller 22, conductive rubber rollers, such as conductive silicone rubber or the like, can be used satisfactorily.

In order to increase the efficiency for carrying the developer, it is preferable for the coefficient of friction of the development roller with respect to the developer to be 0.5 or more and for the surface roughness of the development roller to be smaller than the particle sizes of the developer, for instance, when the particle size is $10\mu$, the surface roughness is 3 to $10\mu$. In order to improve the development condition, it is preferable for the hardness of the rubber to be at 30° to 40°.

When the rotating speed of the development roller is the same as, or more than, but not exceeding two times as great as that of the photoconductive drum 8 at the contacting portion with the photoconductive drum 8, no background appears and development with a sufficiently high density can be accomplished. To the development roller 22 is applied a development bias from outer bias power source 26 so that adhesion of the developer to the background portions on the photosensitive drum is prevented. As charger 23, a scorotron charger having a charging control grid can be used so that the developer can be subjected to charging control.

When a one-component insulating toner is used as the developer 20, instead of the corona discharger 23, a triboelectric charging member which is different in triboelectric series can be used in order to charge the tones triboelectrically.

When a one-component magnetic toner is used as the developer 20, a magnet, which magnetically attracts the magnetic toner to the surface of the development roller 22, can be mounted inside the development roller 22.

When the gap between the developer regulating plate 21a and the development roller 22 is set in the range of 0.03 to 0.06 mm, a uniform layer of the developer may be formed on the development roller 22.

According to experiments conducted by the inventors of this invention, it was confirmed that an uneven development was caused when the thickness of the developer layer was not even. Although the developer layer is initially formed evenly on the development roller 22, during the initial development the developer in the portions corresponding to the electrostatic image on the photoconductive drum 8 is removed electrostatically and thus the layer of the developer on the development roller 22 becomes uneven after development. When the development roller 22, after this further rotation, passes through the inside of the hopper 21, the developer is replenished to the uneven concave portions.

However, it was found that the concave portions of the layer of the developer could not be filled with the replenished developer when the peripheral speed of the developer roller 22 was 50 mm/sec and the replenishment width of the hopper 21 was 10 mm.

Figure 6:
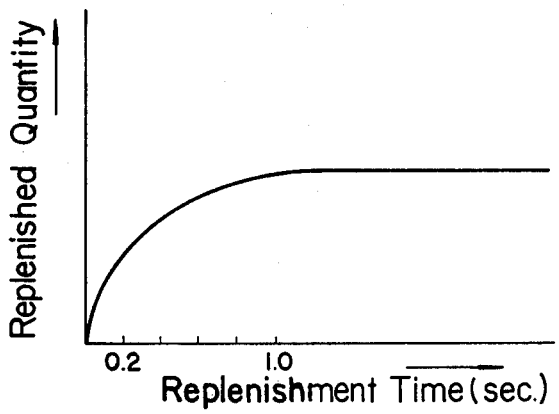

FIG. 6 is a plot showing how long it will take before the concave portions of the layer of the developer are completely filled with the replenished developer when the peripheral speed of the development roller and the replenishment width of the hopper are held constant.

When the replenishment width is 10 mm, the replenishment time of the developer at a point on the roller surface is 0.2 seconds. At this time, only half of the developer is replenished to the concave portions. When the replenishment time is lengthened to 1.0 second or longer, the developer is replenished completely to the concave portions and accordingly the replenishment amount is saturated.

Therefore, in order to set the replenishment time of the developer to at least 1.0 second, the development apparatus must be designed so as to reduce the peripheral speed of the development roller or so as to increase the replenishment width of the developer of the hopper to 50 mm, that is, to five times as wide as 10 mm.

Thus in order to make a uniform layer of the developer on the development roller 22 by use of the developer regulating member 21*a*, a uniform layer of the developer must exist on the development roller 22 before the developer comes in contact with the development regulating member 21*a*. Further scattering of the developer from the hopper 21 can be prevented by the developer regulating member 21*a* and the roller 24, which are mounted at the outlet and the inlet of the hopper 21, respectively. This permits mounting of the outlet and inlet of the hopper not only above the developer roller 22, but also under the horizontal plane including the axis of the development roller 22. Thus, it is possible to increase the contacting area of the hopper 21 with the development roller 22 so that a uniform layer of the developer can be formed on the development roller.

In the above explanation about one embodiment of this invention, the developer regulating member 21*a* is mounted on and at the outlet of the hopper 21, as an example. From this explanation, it will be understandable that a developer regulating member according to the present invention could be mounted separately immediately behind the outlet of the hopper.

Also, it has been explained that the developer on the development roller 22 is electrically charged by use of the charger 23.

However, it is unnecessary to use such a charger if the developer regulating member 21*a* is made of a material or materials different in the triboelectric series from the toner, and itself acts as a simple and inexpensive development apparatus.

FIGS. 7 to 13 relate to another preferred embodiment of development apparatus employing a plurality of developer regulating members or triboelectric charging blades according to the present invention.

As mentioned previously, in development apparatus for use with electrophotographic copying apparatus relating to the present invention, in particular, when toner is electrically charged by a triboelectric charger at the time or immediately after the toner is deposited on the surface of a development roller and is then brought into contact with a photoconductor, the condition of the toner layer formed on the peripheral surface of the development roller is changed delicately depending upon the shape of the triboelectric charger.

Figure 7:
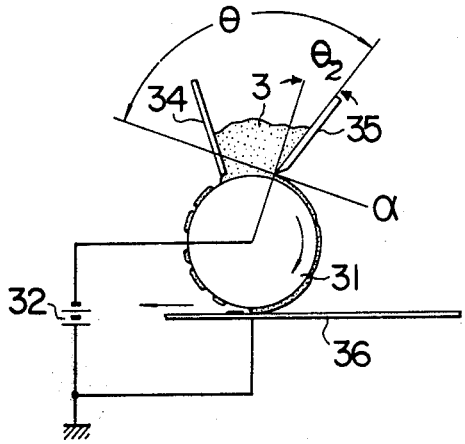
FIG. 7 is a schematic sectional side elevation of another preferred embodiment of development apparatus employing a single triboelectric charging blade according to the present invention.

FIG. 7 illustrates another embodiment of development apparatus employing a single triboelectric charger which is similar to the embodiment shown in FIG. 2. In this figure, the numeral 31 is a development roller made of conductive rubber, which is mounted rotatably in the development apparatus. To the development roller 31 is applied a predetermined bias potential by direct current source 32.

Above the development roller 31 is mounted toner tank 34 holding toner 3 with an opening at the bottom thereof. At one side of the toner tank 34 is disposed a triboelectric charging blade 35 forming an obtube angle $\theta$ with a tangent $\alpha$ to a point on the surface of the development roller 31 opposite its tip, measured from the side of the tangent upstream of the point in the direction of rotation of the roller. Under the development roller 31 is positioned a latent electrostatic image bearing photoconductive 36 which is capable of being moved in one direction. In the development apparatus of this type, the toner 3 in the toner tank 34 is scraped out by the rotation of the development roller 31, followed by being charged by the triboelectric charging blade 35 and being brought into close contact with the photoconductor 36. Here, the triboelectric charging blade 35 is disposed in the manner shown forming the obtuse angle $\theta$ with a tangent $\alpha$ to the development roller 31 or the acute angle $\theta_2$ with the plane including the axis of the roller 31 and the top edge of the blade. Therefore, as in the embodiment in FIG. 2, this apparatus has an advantage of being capable of forming a uniform and thin layer of the toner on the development roller 31 and also, coagulation of the toner rarely occurs.

Figure 8:
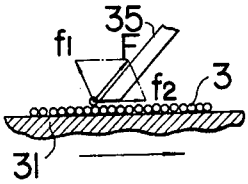
FIG. 8 is a schematic illustration of the mechanism of the blade section of FIG. 7.

However, in the case where the toner in the toner tank becomes insufficient in amount or the toner is not sufficiently replenished, a uniform and thin layer of the toner may not be always be formed on the development roller 31. This is because in the development apparatus as shown in FIG. 7, such a phenomenon as illustrated in FIG. 8 occurs. Namely, the carriage force $f_2$ received by the toner 3 is directed along a tangent of the surface ro the development roller 31, and the reaction $f_1$ from the triboelectric charging blade is normal to the surface of the triboelectric charging blade 35. Accordingly, the resultant force F applied to the toner is directed nearly along the surface of the triboelectric blade 5. Therefore, the resultant force F is not directed to the development roller 31. As a result, a uniform and thin layer of the toner may not always be formed when replenishment of the toner becomes insufficient.

Figure 9:
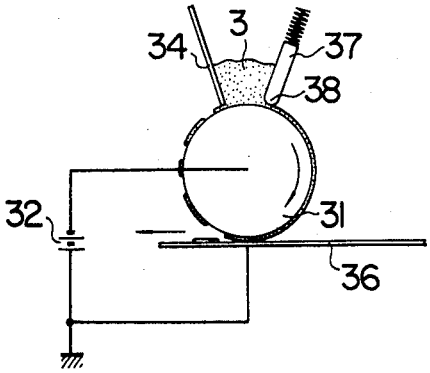
FIG. 9 is a schematic sectional side elevation of a development apparatus employing another single triboelectric charging blade.
Figure 10:
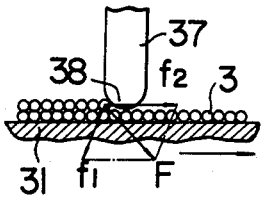
FIG. 10 is a schematic illustration of the mechanism of the blade section of FIG. 9.

FIGS. 9 and 10 illustrate a further embodiment of development apparatus employing a single triboelectric charging blade. In this apparatus, the triboelectric charging blade 37 has an arc-shaped tip 38. This results in the fact that the top surface of the triboelectric charging blade forms an acute angle with the tangent $\alpha$ of the development roller. This situation corresponds to the cases in FIGS. 3 and 4.

The apparatus of this type has an advantage of being excellent in the replenishment of the toner 3 even if the toner in the toner tank begins to become smaller in amount. This is because in the development apparatus as shown in FIG. 9, such a phenomenon as illustrated in FIG. 10 occurs.

Namely, since the reaction $f_1$ from the triboelectric charging blade is directed downwardly and taking into consideration the carriage force $f_2$, the resultant force F applied to the toner is directed toward the development roller 31. Thus, this apparatus is excellent in the replenishment of the toner 3 when the supply is low.

However, as mentioned in the cases of FIGS. 3 and 4, when there is a sufficient amount of the toner in the toner tank, this apparatus is apt to make the toner layer thick or cause background or deteriorate tone grades or sharpness of the image.

Therefore, the development apparatus having a single triboelectric charging blade has its own advantages, but at the same time, it has some shortcomings.

Figure 11:
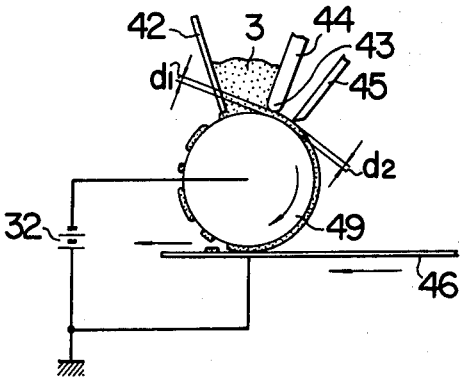
FIG. 11 is a sectional side elevation of a preferred embodiment of development apparatus employing a pair of triboelectric charging blades according to the present invention.

FIG. 11 illustrates a preferable embodiment of development apparatus employing a plurality of triboelectric charging blades according to the present invention. This invention is characterized in that a plurality of triboelectric charging blades are provided, the respective angle of the top surface of the blades with respect to the respective tangents to the surface of the development roller vary from an acute angle to an obtuse angle measured from the side of the tangent upstream in the direction of the rotation of the development roller. This arrangement of the triboelectric charging blades permits sufficient replenishment of toner to the development roller in the first place and then forms a uniform and thin layer of toner on the roller. Therefore, images without background and excellent in tone grades and uniform in solid areas can be obtained.

Further, the use of a plurality of the triboelectric charging blades shortens the period of time before the potential of charged toner reaches its saturation. This also serves to improve the image quality.

Figure 12:
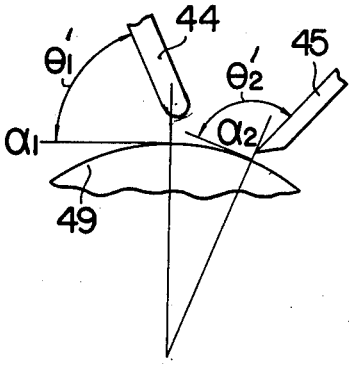
FIG. 12 is an enlarged sectional elevation of the pair of triboelectric charging blades of FIG. 11.
Figure 13:
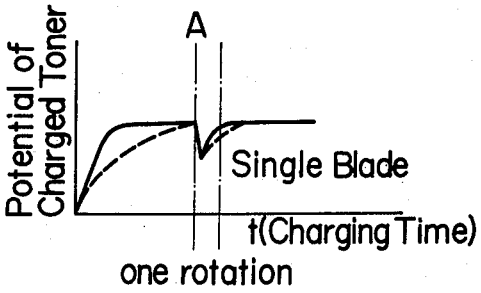
FIG. 13 is a characteristic diagram showing the relationship between the charging time and the potential of charged toner.

In FIGS. 11 to 13, development roller 49 is made of a conductive rubber or the like and is rotatably mounted for transfer of toner to a photoconductor 46. To the development roller 49 is applied a predetermined bias potential by direct current power source 32.

Above the development roller 49 is mounted toner tank 42 holding toner 3 with an opening at the bottom thereof. At one side of the toner tank 42 is disposed triboelectric charging blade 44 having arc-shaped tip portion 43 with space $d_1$ between the triboelectric charging blade 44 and the development roller 49. In addition to this, triboelectric charging blade 45 having a sharp edge shaped like a knife edge is disposed along the rotating direction of the development roller with space $d_2$, which is smaller than $d_1$, between the development roller 49 and the tip of the blade 45.

The angles $\theta_1'$ and $\theta_2'$ formed by these triboelectric charging blades and the respective tangents $\alpha_1$ and $\alpha_2$ thereof are substantially set in the range of $0° < \theta_1' < 90°$, $90° < \theta_2' < 180°$, respectively.

In such a construction, a layer of the toner from the toner tank 42 is formed with a predetermined thickness on the surface of the development roller 49 while the toner is being triboelectrically charged by the triboelectric charging blade 44. In this portion, as shown in FIG. 10, replenishment of the toner 3 is good and a rather thick and uniform layer of the toner is formed. Subsequently, the toner layer is made thin while it is further charged by the triboelectric charging blade 45. At this stage, as a sufficient amount of the toner 3 has already been supplied, a uniform layer of the toner with a desired thickness is formed.

With respect to the condition of charging saturation of the toner, the period of time before the charging saturation is reached is shorter than in the case of the development apparatus with a single triboelectric charging blade as respectivly illustrated by the full and dotted lines in FIG. 13. Therefore, when copying is started at the time A and the charging potential of the toner is lowered, the period of time before the toner recovers its charging potential is rather short with the two triboelectric charging blades. This serves to improve image qualities, making solid areas uniform with a sufficient density and also making background less and improving the toner grades.

In this embodiment, a couple of triboelectric charging blades are employed. More triboelectric charging blades can be incorporated as well. Also, instead of employing a plurality of triboelectric charging blades, an integrated triboelectric charger with a plurality of blades can be used.

What is claimed is:

1. In a development apparatus for use in a copying apparatus of the type having a development roller which is rotated in close proximity to a latent electrostatic image bearing recording material, a hopper for supplying an insulating toner onto said development roller and a developer regulating member with a flat top surface and a bevelled edge disposed at the outlet of said hopper, the improvement wherein said developer regulating member is positioned in the manner that the top surface of said developer regulating member forms an angle $\theta_1$ in the range of $0° < \theta_1 \leqq 90°$ with the bevelled surface of the edge of said developer regulating member and also forms an angle $\theta_2$ in the range of $° \leqq \theta_2 < 90°$ with the plane including the top edge of said developer regulating member and the axis of said development rotation of said development roller and wherein upstream of said developer regulating member in the direction of rotation of said development roller, at least one additional developer regulating member is disposed in the manner that the surface thereof, which comes in contact with the toner, forms an actute angle with a tangent to a point on the surface of said development roller right under the top edge of said additional developer regulating member on the side of the tangent upstream in the direction of rotation of said development roller.

2. A development apparatus as in claim 1 wherein said developer regulating member and said additional developer regulating member are disposed such that a predetermined distance between the top edge of said developer regulating member and the peripheral surface of said development roller is smaller than that between the top edge of said additional developer regulating member and the peripheral surface of said development roller.

3. A development apparatus as in claim 1 wherein said additional developer regulating member is a triboelectric charging member.

4. A development apparatus as in claim 1 wherein the surface of said additional developer regulating member which comes in contact with the toner is of an arcuate shape.

5. A development apparatus for use in copying apparatus comprising:

a development roller which is rotated in close proximity to a latent electrostatic image bearing recording material;

a hopper for supplying an insulating toner, which can be triboelectrically charged, onto said development roller; and a developer regulating means of a material different from said toner in the triboelectric series, and having a flat top surface and a bevelled edge, disposed at the outlet of said hopper with the top surface forming an angle $\theta_1$ in the range of $0° < \theta_1 \leqq 90°$ with the bevelled surface of the edge of said developer regulating member and also forming an angle $\theta_2$ in the range of $0° < \theta_2 < 90°$ with the plane including the top edge of said developer regulating means and the axis of said development roller on the downstream side of said plane in the direction of rotation of said development roller, for triboelectrically charging said toner.

6. A development apparatus as in claim 5 wherein upstream of said developer regulating means in the the direction of rotation of said development roller, at least one additional developer regulating means is disposed in the manner that the surface thereof, which comes in contact with the toner forms an acute angle with a tangent to a point on the surface of said development roller right under the top edge of said additional developer regulating means on the side of the tangent upstream in the direction of rotation of said development roller.

7. A development apparatus as in claim 6 wherein said developer regulating means and said additional developer regulating means are disposed such that a predetermined distance between the top edge of said developer regulating means and the peripheral surface of said development roller is smaller than that between the top edge of said additional developer regulating means and the peripheral surface of said development roller.

8. A development apparatus as in claim 6 wherein said additional developer regulating member is a triboelectric charging member.

* * * * *